United States Patent [19]

Warburton et al.

[11] 4,410,404

[45] Oct. 18, 1983

[54] MEMBRANE CELL AT INCREASED CAUSTIC CONCENTRATION

[75] Inventors: Craig S. Warburton, Mentor; Stanley K. Baczek, Painesville, both of Ohio

[73] Assignee: Diamond Shamrock Corporation, Dallas, Tex.

[21] Appl. No.: 277,906

[22] Filed: Jun. 26, 1981

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,041,317 | 6/1962 | Gibbs et al. | 260/79.3 |
| 3,282,875 | 11/1966 | Connolly et al. | 260/29.6 |
| 3,624,053 | 11/1971 | Gibbs et al. | 260/79.3 |
| 3,985,631 | 10/1976 | Hora et al. | 204/98 |
| 4,025,405 | 5/1977 | Dotson et al. | 204/98 |
| 4,026,783 | 5/1977 | Grot | 204/296 |
| 4,026,783 | 5/1977 | Grot | 204/266 |
| 4,040,919 | 8/1977 | Eng | 204/98 |
| 4,056,448 | 11/1977 | Babinaky et al. | 204/98 |
| 4,081,349 | 3/1978 | Hora et al. | 204/252 |
| 4,085,071 | 4/1978 | Resnick et al. | 260/22 R |
| 4,147,844 | 4/1979 | Babinsky et al. | 521/27 |

FOREIGN PATENT DOCUMENTS

| | | | |
|---|---|---|---|
| 7212249 | 3/1973 | Netherlands | 521/27 |
| 1184321 | 3/1970 | United Kingdom | 204/252 |

*Primary Examiner*—R. L. Andrews

*Attorney, Agent, or Firm*—Bruce E. Harang

[57] ABSTRACT

An improved process for producing high purity caustic in a chlor/alkali cell utilizing a sulfonamide membrane allowing for improved current efficiency with approximately constant voltage by increasing the caustic concentration of the catholyte substantially above the normal level used in this type of cell.

12 Claims, No Drawings

MEMBRANE CELL AT INCREASED CAUSTIC CONCENTRATION

BACKGROUND OF THE INVENTION

A large portion of the chlorine and alkali metal hydroxide production throughout the world is manufactured in diaphragm-type electrolytic cells wherein opposed anode and cathode are separated by a fluid permeable diaphragm, usually of asbestos, defining separate anode and cathode compartments. In a typical operation, saturated brine is fed to the anode compartment wherein chlorine is generated at the anode, the brine percolating through the diaphragm into the cathode compartment wherein sodium hydroxide is produced at a concentration within the range of 11 to 18 percent and "contaminated" with large amounts of sodium chloride. The sodium hydroxide must then be concentrated by evaporation, and the chloride must be removed to provide a commercial product.

Through the years, substitution of a membrane material for the diaphragm has been proposed. These membranes are substantially impervious to hydraulic flow. In operation, an alkali metal chloride solution is again introduced into the anode compartment wherein chloride is liberated. Then, in the case of a cation permselective membrane, alkali metal ions are transported across the membrane into the cathode compartment. The concentration of the relatively pure alkali metal hydroxide produced in the cathode compartment is determined by the amount of water added to this compartment, generally from a source exterior to the cell. While operation of a membrane call has many theoretical advantages, its commercial application to the production, for example, of chlorine and caustic has been hindered owing to the low current efficiencies obtained and the often erratic operating characteristics of the cell.

More recently much improved membranes have been developed to overcome many of the prior problems. The must important such membrane is a thin film of fluorinated copolymer having pendant sulfonyl fluoride groups thereon such as described in U.S. Pat. Nos. 3,041,317; 3,282,875; and 3,624,053 and the like. Such membranes in hydrolyzed form are available from E. I. duPont de Nemours & Company under the trademark NAFION ®.

These membranes can be further improved by surface treatments which consist of reacting the sulfonyl fluoride pendant groups with ammonia gas or more preferably with an amine which will yield less polar binding and thereby absorb fewer water molecules by hydrogen bonding such as described in detail in U.S. Pat. No. 4,081,349. The more efficient of these modified membranes are highly cross-linked and become extremely brittle especially in commercial dimension.

To futher improve on these modified membranes, a fabric reinforced material has been laminated to such membranes by the application of heat and pressure. Such treatment, however, has resulted in improvement from a mechanical standpoint but is found lacking in that the heat and pressure required in the fabric bonding operation impairs, if not completely destroys, the effectiveness of the amine modified surface. Methods have now been described, however, which allow the mechanical advantages of a bonded membrane without losing the chemical advantages of the amine modification such as, for example, the method described in U.S. Pat. No. 4,147,844.

In all of these membrane technologies, however, there continues to be the normal degradation of the membrane over time during its operating life. The amount of time before these membrane cells become economically unacceptable has, in the past, been rather short, and therefore costly downtime and replacement costs are incurred in using membrane cells in the chlor-/alkali manufacturing process.

SUMMARY OF THE INVENTION

Therefore, it is an object of the present invention to provide an improved method of operating chlor/alkali membrane cells using membranes containing a thin film of fluorinated copolymer having pendant sulfonamide groups thereon so as to greatly increase the longevity of the membrane in the cell.

The present invention not only is able to slow the degradation of the cell which causes a drop in current efficiency but, in many cases, is able to reverse the current efficiency drop and actually cause a rise or higher current efficiency than was available in the new membrane when the cell was first activated.

Broadly stated, the present invention comprises a process for producing high purity caustic in a chlor/alkali membrane cell utilizing a sulfonamide membrane wherein said membrane faces the cathode comprising: (a) operating said cell normally until the current efficiency (C.E.) of said cell has dropped below an acceptable level; (b) increasing the caustic concentration to a substantially greater than normal level, restoring or improving said current efficiency of said cell thereby; and (c) operating said cell at said restored or improved current efficiency level; wherein the brine feed concentration of said cell is maintained at a saturated brine concentration level.

DETAILED DESCRIPTION

The membrane cells to which the present invention applies, as well as the operating conditions thereof, are in many respects conventional. Generally, an enclosure is provided and divided into two compartments by the modified membrane material. In one compartment is disposed an appropriate cathode, generally a metallic material, such as mild steel and the like. The other compartment contains the anode—a conductive electrocatalytically active material, such as graphite or, more desirably, a dimensionally stable anode, e.g., a titanium substrate bearing a coating of a platinum group metal, platinum group metal oxide, or other electrocatalytically active, corrosion-resistant material. The anode compartment is provided with an output for generated chlorine gas, an inlet for alkali metal chloride (i.e., NaCl or KCl solution) and an outlet for depleted electrolyte. Similarly, the cathode compartment will have outlets for liquid and gaseous products and, generally, an inlet through which water and/or an alkali metal hydroxide solution may be added. In operation, a direct current, generally on the order of from 15 to 45 amps per square decimeter of membrane, is passed between the electrodes, causing the generation of chlorine at the anode and the selective transport of hydrated alkali metal ions across the membrane into the cathode compartment wherein they combine with hydroxide ions formed at the cathode by the electrolysis of water, hydrogen gas being liberated.

The membranes used in the cells of the present invention are generally derived from (i.e., result from the amination and saponification of) any fluorinated polymer having pendant side chains bearing sulfonyl groups attached to carbons, on each of which carbons there is at lest one fluorine atom. The fluorinated polymers are prepared from monomers that are fluorinated or fluorine-substituted final components. They are made from at least two monomers with at least one of the monomers coming from each of the groups (1) fluorinated vinyl compounds, such as vinyl fluoride, hexafluoropropylene, vinylidene fluoride, trifluoroethylene, chlorotrifluoroethylene, perfluoro (alkyl vinyl) ether, tetrafluoroethylene, and mixtures thereof, and (2) a sulfonyl-containing monomer containing the precursor $—SO_2F$. Exemplary are $CF_2{=}CFSO_2F$ and, generically, $CF_2{=}CFY_fSO_2F$, where $Y_f$ is a bifunctional perfluorinated radical containing from 2 to 8 carbon atoms.

The preferred hydraulically impermeable membrane which can be used in the practice of the present invention is a thin film of fluorinated copolymer having pendant sulfonyl fluoride groups. The fluorinated copolyner is derived from monomers of the formula $CF_2{=}CF(R)_nSO_2F$ in which the pendant $—SO_2F$ groups are converted to $—SO_3H$ groups in use, the monomers of the formula $CF_2{=}CXX'$ wherein R represents the group $$\begin{array}{l} R' \\ | \\ CF—CF_2—O—(CFY—CF_2O)_m \end{array}$$

in which the R' is fluorine or fluoroalkyl of 1 to 10 carbon atoms; Y is fluorine or trifluoromethyl; m is 1, 2 or 3; n is 0 or 1; X is fluorine, chlorine or trifluoromethyl; and X' is X or $CF_3(CF_2)_zO$ wherein z is 0 or an integer from 1 to 15.

This results in copolymers in the membrane used for the cell having the repeating structural units $$—CF_2—CF—(R)_n—SO_3H \quad (3)$$

and $$—CF_2\text{-}C_{XX'} \quad (4).$$

In the copolymer, there should be sufficient repeating units according to formula (3) above, to provide an $—SO_3H$ equivalent weight of about 800 to 1600 with a preferred range of 1000 to 1400. Membranes having a water absorption of about 25 percent or greater are preferred since higher cell potentials at any given current density are required for membranes having less water absorption. Similarly, membranes having a film thickness (unlaminated) of about 8 mils or more require higher cell potentials in the process of the present invention and thus have a lower power efficiency.

Because of large surface areas of the membrane present in commercial cells, the membrane film will be laminated to and impregnated into a hydraulically permeable, electrically nonconductive, inert, reinforcing member, such as a woven or nonwoven fabric made of fibers of asbestos, glass, TEFLON® (available from E. I. duPont de Nemours & Company), or the like. In film-/fabric composite membranes, it is preferred that the laminating produce an unbroken surface of the film resin on at least one side of the fabric to prevent leakage through the membrane. The side having the unbroken surface of the membrane films must face the cathode.

The hydraulically impermeable cation-exchange membranes of the type in question are further described in the following patents which are hereby incorporated by reference; U.S. Pat. Nos. 3,041,317; 3,282,875, 3,624,053; British Pat. No. 1,184,321 and Dutch published application 72/12249. Membranes in hydrolyzed form as afore described are available from E. I. duPont de Nemours & Company under the trademark NAFION.

These fabric reinforced membranes, in the unhydrolyzed sulfonyl form and generally having a thickness of from 75 to 250 microns, especially 125 to 200 microns, are then treated with primary or secondary amines as disclosed, for example, in U.S. Pat. No. 4,081,349.

Amine chemical surface treatment of the sulfonyl fluoride precursor of such fabric-reinforced NAFION membranes has been shown to be a practical method for increasing the current efficiency in a chlor/alkali cell. Generally, these amine surface treatments consist of reacting the sulfonyl fluoride pendant groups with amines that will yield less polar bonding and thereby absorb fewer water molecules by hydrogen bonding. This tends to narrow the pore openings through which the cations travel so that less water of hydration is transmitted with the cation through the membrane. All reactive amines, including primary and secondary amines as well as mono-, di-, tri- and tetra-amines and ammonium modify the membranes to improve current efficiency and minimize —OH transport to varying degrees. Generally, amines which more highly cross-link the polymeric membrane best minimize —OH transport through the membrane. Likewise, lower molecular weight cross-linking amines, particularly ethylene diamine, perform better at minimizing —OH transport than higher molecular weight cross-linking amines. The general corollary that can be drawn is that the greater the cross-linking with amines the better the cation transmission in the forward direction with less hydroxyl ion back migration.

Polyamines also produce extensive cross-linking, good cell voltage, excellent current efficiency and are easy to reproduce. Among the polyamines, ethylene diamine is the best with improvement falling off as the branching of the amine increases, length of cross-linking increases, and molecular weight increases.

As is well-known in the art, a wide variety of amines can be employed in this modification of the NAFION pendant sulfonyl groups. Typical examples include ethylene diamine, propylene diamine, butylene diamine, diethylene triamine, dipropylene triamine, triethylene tetramine, methylamine, ethylamine, and N-butylamine.

These above-identified membranes provide good cell voltage and excellent current efficiency when they are first put on line. Generally, however, they will have a degradation of the current efficiency of approximately 0.03 percent per day on line (DOL). Thus, for example, a cell that starts with a current efficiency of approximately 90 percent would, at the end of 360 days on line, have a current efficiency of approximately 79 percent. In most operations, a current efficiency below the range of 80 to 85 percent is no longer economical, and therefore the cells would be shutdown to allow for replacement of the membranes. It will be appreciated that for a given chlor/alkali plant using the cells described above, the economics of operation are dependent on a number of factors. Generally the factors that tend to determine the economics of the plant and therefore when a set of cells must be shut down for membrane replacement are the characteristics of the particular cell design being used, the characteristics of the particular membranes being used in the cells and the power imput generally described as DC kilowatt hours/ton of caustic produced. Thus, by "economically acceptable level" is meant a level of caustic production which that particular plant can accept and still make the profit its owners need. While this point is not ameanable to a hard and fast time frame, it is generally used in and understood by the chlor/alkali industry.

In the present invention, an "acceptable level" may be any current efficiency (C.E.) level below the starting current efficiency level, e.g., if a particular cell is established after start-up at approximately 90 percent C.E., the acceptable level might be approximately 84 to 87 percent C.E. However, as is well understood in the chlor/alkali art for most operations, an acceptable level can be 80 to 85 percent C.E. Usually then a drop in C.E. below 80 percent will provide an unacceptable C.E. level for the cell.

By using the novel method of the present invention, that same cell, even if the novel method was started when the current efficiency had dropped off below 80 percent, would see a dramatic improvement in current efficiency which, in many instances, may actually be higher than the initial current efficiency of the cell, even after 600 plus days on line. Thus, it is presently contemplated that the most preferred embodiment of the present invention would be to start the use of the present invention at the point which the membrane would normally be replaced in the cell. However, it is also understood that this novel method may be used at any point during the life cycle of the chlor/caustic cell. It is appreciated, however, that initially starting the caustic concentration that the higher rates described hereinbelow is not advantageous because one would also then have to dilute the brine input. This is shown, for example, in U.S. Pat. No. 4,056,448 wherein an initial concentration of caustic of 560 g/l±20 g/l is used at the outset, but it is critical that in order to make the cell work, the brine input be 190 g/l±20 g/l which is well below, and far more dilute, than the generally used saturated brine. The catholyte caustic concentration of the present invention is generally from approximately 400 g/l to 500 g/l, preferably 410 to 440 g/l. This increase in caustic strength, however, does not necessitate the dilution of the brine input, i.e., it may be used with saturated brine, as is generally the standard in the industry, of approximately 310 g/l concentration. It will be further appreciated that the higher caustic concentration may be attained by adding a concentrated caustic from an outside source. This higher caustic concentration can also be realized by stopping and restarting the water input, reducing the water input, or pulsing the water input or combinations thereof as well as in combination with higher concentration caustic addition. However, the currently preferred embodiment produces the higher caustic concentration by reducing the water input to the catholyte compartment, thereby allowing the caustic concentration to rise naturally in the course of cell operation. This preferred method enhances maintenance of cell efficiency. It is also understood that the present invention can be practiced in the cathode compartment and also in the circulation system in those cell configurations utilizing a circulating catholyte system.

The conditions: pH of the brine feed, pH in the anolyte compartment, temperatures used in the cells are those commonly used in the art. They are not critical to the present invention. Thus, for example, temperatures in the range of 65° to 100° C. and brine feed pH=1 and anolyte pH in the range of 3.5 to 4.0 are acceptable for use with the present invention. Further, the configuration of the actual cells within the general scope of the cell outlined hereinabove is of no criticality to the use of the instant invention.

The invention is illustrated below in the examples. These examples are illustrative only and are not limitations upon the present invention.

EXAMPLE 1 (Comparison)

The cell comprises a cathode compartment containing a steel mesh electrode and separated from an anode compartment containing an expanded titanium electrode bearing a Beer coating on its surface, by a membrane produced by diamine treating a duPont NAFION cation exchange membrane to produce a membrane of 4 mils thickness, 1100 EW NAFION of which 1.3 mils has been treated with EDA. The working surface area of this membrane in the cell was 3.0 sq.in. from a square membrane 3.5 inches on a side. Saturated brine was used throughout the test. The temperature of the cell was 85° C. The caustic concentration, current efficiency (C.E.), voltage, amps/sq.in. and dc kwh/T are shown, in Table 1 below, versus days on line (DOL). The caustic concentration was raised by slowing down the water input rate to the cathode compartment. The caustic concentration was measured by specific gravity and/or titration.

TABLE I

| DAYS ON LINE | VOLTAGE | NaOH GPL | C.E. % | DC KWH/MT | AMPS/ $IN^2$ |
|---|---|---|---|---|---|
| 11 | 3.62 | 354 | 94.0 | 2582 | 2 |
| 34 | 3.23 | 358 | 93.1 | 2346 | 1 |
| 65 | 3.61 | 360 | 92.1 | 2625 | 2 |
| 95 | 3.59 | 359 | 89.1 | 2705 | 2 |
| 125 | 3.48 | 360 | 89.0 | 2620 | 2 |
| 155 | 3.50 | 338 | 87.5 | 2680 | 2 |
| 185 | 3.37 | 359 | 87.5 | 2580 | 2 |
| 215 | 3.46 | 358 | 86.3 | 2686 | 2 |
| 245 | 3.44 | 361 | 85.6 | 2692 | 2 |
| 275 | 3.76 | 376 | 84.9 | 2967 | 2 |
| 297 | 4.00 | 379 | 81.9 | 3272 | 2 |

This comparison example shows the normal C.E. degradation of this type of cell without the use of the present invention.

EXAMPLE 2

The cell comprises a cathode compartment containing a steel mesh electrode and separated from an anode compartment containing an expanded titanium electrode bearing a Beer coating on its surface, by a membrane produced by diamine treating a duPont NAFION cation exchange membrane to produce a membrane of 4 mil thickness 1100 EW NAFION of which 1.3 mils has been treated with EDA. The working surface area of this membrane in the cell was 3.0 sq.in. from a square membrane 3.5 inches on a side. Saturated brine was used throughout the test. The cell temperature was 85° C. The caustic concentration, current efficiency (C.E.), voltage, amps/sq.in. and dc kwh/T are shown, in Table II below, versus days on line (DOL). The caustic concentration was raised by slowing down the water input rate to the cathode compartment. The caustic concentration was measured by specific gravity and/or titration.

TABLE II

| DAYS ON LINE | VOLTAGE | NaOH GPL | C.E. % | DC KWH/MT | AMP/ $IN^2$ |
|---|---|---|---|---|---|
| 10 | 3.62 | 370 | 91.1 | 2662 | 2 |
| 30 | 3.12 | 371 | 90.0 | 2321 | 1 |
| 40 | 3.61 | 399 | 92.0 | 2629 | 2 |
| 90 | 3.10 | 346 | 86.2 | 2411 | 1 |
| 105 | 3.54 | 358 | 90.6 | 2618 | 2 |
| 135 | 3.14 | 337 | 86.6 | 2429 | 1 |
| 165 | 3.12 | 355 | 83.3 | 2506 | 1 |
| 195 | 3.15 | 356 | 81.0 | 2603 | 1 |
| 225 | 3.10 | 356 | 79.0 | 2632 | 1 |
| 255 | 3.13 | 364 | 76.9 | 2732 | 1 |
| 285 | 3.14 | 380 | 79.6 | 2642 | 1 |
| 315 | 3.15 | 370 | 82.5 | 2569 | 1 |
| 345 | 3.14 | 361 | 87.4 | 2407 | 1 |
| 375 | 3.16 | 373 | 88.2 | 2402 | 1 |
| 405 | 3.25 | 404 | 90.5 | 2405 | 1 |
| 435 | 3.24 | 408 | 90.0 | 2413 | 1 |
| 465 | 3.26 | 413 | 89.7 | 2434 | 1 |
| 495 | 3.25 | 412 | 88.9 | 2446 | 1 |
| 510 | 3.24 | 417 | 89.7 | 2418 | 1 |
| 555 | 3.65 | 404 | 82.4 | 2971 | 2 |
| 565 | 3.23 | 409 | 85.5 | 2531 | 1 |

This example clearly shows the improved C.E. of this type of cell utilizing the present invention.

EXAMPLE 3

The cell comprises a cathode compartment containing a steel mesh electrode and separated from an anode compartment containing an expanded titanium electrode bearing a Beer coating on its surface, by a membrane produced by diamine treating a duPont NAFION cation exchange membrane to produce a membrane of 4 mils thickness, 1100 EW NAFION of which 1.3 mils has been treated with EDA. The working surface area of this membrane in the cell was 3.0 sq.in. from a square membrane 3.5 inches on a side. Saturated brine was used throughout the test. The temperature of the cell was 85° C. The caustic concentration, current efficiency (C.E.), voltage, amps/sq.in. and dc kwh/T are shown, in Table III below, versus days on line (DOL). The caustic concentration was raised by slowing down the water input rate to the cathode compartment. The caustic concentration was measured by specific gravity and/or titration.

TABLE III

| DAYS ON LINE | VOLTAGE | NaOH GPL | C.E. % | DC KWH/MT | AMPS/ $IN^2$ |
|---|---|---|---|---|---|
| 10 | 3.66 | 373 | 91.5 | 2681 | 2 |
| 20 | 3.98 | 368 | 91.5 | 2912 | 2 |
| 30 | 3.59 | 384 | 91.4 | 2635 | 2 |
| 40 | 3.68 | 274 | 92.8 | 2656 | 2 |
| 50 | 3.69 | 384 | 92.9 | 2658 | 2 |
| 60 | 3.74 | 403 | 93.5 | 2678 | 2 |
| 70 | 3.72 | 415 | 93.9 | 2657 | 2 |
| 80 | 3.76 | 443 | 93.9 | 2681 | 2 |
| 90 | 3.76 | 445 | 92.8 | 2713 | 2 |
| 100 | 4.00 | 472 | 98.6 | 2991 | 2 |
| 110 | 3.90 | 446 | 90.6 | 2881 | 2 |
| 120 | 3.90 | 450 | 84.8 | 3081 | 2 |
| 130 | 3.82 | 439 | 87.0 | 2940 | 2 |
| 140 | 3.62 | 385 | 92.0 | 2630 | 2 |
| 150 | 3.59 | 365 | 91.3 | 2633 | 2 |
| 160 | 3.58 | 370 | 92.8 | 2587 | 2 |
| 170 | 3.64 | 392 | 92.1 | 2648 | 2 |
| 190 | 3.73 | 413 | 88.0 | 2841 | 2 |

This example shows that starting cell initially at the higher caustic concentration does not provide the benefits of the present invention.

While there has been shown and described what is believed at present to constitute the preferred embodiments of the present invention, it will be obvious to those skilled in the art that various changes and modifications may be made therein without the parting from the scope of the invention as defined by the appended claims.

What is claimed is:

1. A process for producing high purity caustic in a chlor/alkali membrane cell utilizing a sulfonamide membrane and also utilizing a substantially saturated brine feed concentration comprising:

(a) operating said cell normally until the current efficiency of said cell has dropped below an acceptable level;

(b) increasing the caustic concentration to a substantially greater than normal level, restoring or improving said current efficiency of said cell thereby; and (c) operating said cell at said restored or improved current efficiency level;

wherein the brine feed concentration of said cell is maintained at a substantially saturated brine concentration level.

2. A process for producing high purity caustic in a chlor/alkali membrane cell utilizing a sulfonamide membrane and also utilizing a substantially saturated brine feed concentration comprising:

(a) operating said cell normally until the current efficiency of said cell has dropped below about 80 percent;

(b) increasing the caustic concentration to a substantially greater than normal level, restoring or improving said current efficiency to greater than about 80 percent thereby; and (c) operating said cell at said restored or improved current efficiency level;

wherein the brine feed concentration of said cell is maintained at a substantially saturated brine concentration level.

3. A process as claimed in claims 1 or 2 wherein said caustic concentration is provided by adding a highly concentrated caustic solution to the catholyte compartment from a source outside the cell.

4. A process as claimed in claim 3 wherein said caustic has a concentration of from approximately 400 g/l to about 500 g/l.

5. A process as claimed in claims 1 or 2 wherein said caustic concentration of step (b) is raised to a level of approximately 400 g/l to about 500 g/l.

6. A process as claimed in claims 1 or 2 wherein said caustic concentration of step (b) is raised to a level of from about 410 g/l to 440 g/l.

7. A process as claimed in claims 1 or 2 wherein said high purity caustic produced is rayon grade caustic.

8. A process as claimed in claims 1 or 2 wherein said high purity caustic produced is removed by a substantially continuous means.

9. A process as claimed in claim 8 wherein said high purity caustic removal proceeds substantially uninterrupted by said process.

10. A process as claimed in claims 1 or 2 wherein said sulfonamide membrane is laminated to and impregnated into a hydraulically permeable, electrically nonconductive, inert reinforcing member; and further wherein said sulfonamide membrane surface faces the cathode.

11. A process as claimed in claims 1 or 2 wherein said chlor/alkali membrane cell contains a water inlet into the cathode compartment thereby allowing water to be introduced into said cathode compartment.

12. A process as claimed in claim 11 wherein said higher caustic concentration of step (b) is provided by stopping and restarting, reducing, or pulsing the water input to the catholyte compartment or combinations thereof.

* * * * *